US010337439B2

(12) United States Patent
Seegmüller et al.

(10) Patent No.: US 10,337,439 B2
(45) Date of Patent: Jul. 2, 2019

(54) CONTROL METHOD FOR CONTROLLING A FUEL INJECTION SYSTEM, AND FUEL INJECTION SYSTEM

(71) Applicant: CONTINENTAL AUTOMOTIVE GMBH, Hannover (DE)

(72) Inventors: Oliver Seegmüller, Köfering (DE); Tobias Ritsch, Regensburg (DE)

(73) Assignee: CPT Group GmbH, Hannover (DE)

( * ) Notice: Subject to any disclaimer, the term of this patent is extended or adjusted under 35 U.S.C. 154(b) by 0 days.

(21) Appl. No.: 15/753,042

(22) PCT Filed: Apr. 14, 2016

(86) PCT No.: PCT/EP2016/058223
§ 371 (c)(1),
(2) Date: Feb. 15, 2018

(87) PCT Pub. No.: WO2017/028967
PCT Pub. Date: Feb. 23, 2017

(65) Prior Publication Data

US 2018/0238260 A1 Aug. 23, 2018

(30) Foreign Application Priority Data

Aug. 18, 2015 (DE) ..... 10 2015 215 688

(51) Int. Cl.
*F02D 41/22* (2006.01)
*F02M 59/02* (2006.01)
(Continued)

(52) U.S. Cl.
CPC ..... *F02D 41/221* (2013.01); *F02D 41/22* (2013.01); *F02D 41/222* (2013.01);
(Continued)

(58) Field of Classification Search
CPC ..... F02M 59/025; F02M 59/027; F02M 63/0245; F02D 41/221; F02D 41/222;
(Continued)

(56) References Cited

U.S. PATENT DOCUMENTS 6,024,064 A 2/2000 Kato et al.
8,442,745 B2 * 5/2013 Ando ..... F02D 41/3863 123/479
(Continued)

FOREIGN PATENT DOCUMENTS

DE 19937962 A1 2/2001
DE 102012105818 A1 1/2014
(Continued)

OTHER PUBLICATIONS

International Search Report and Written Opinion dated Aug. 1, 2016 from corresponding International Patent Application No. PCT/EP2016/058223.
Office Action dated Mar. 11, 2016 from corresponding German Patent Application No. 10 2015 215 688.5.
Japanese Notice of Allowance drafted Feb. 20, 2019 for corresponding Japanese patent application No. 2018-508661.

*Primary Examiner* — Erick R Solis

(57) ABSTRACT

The invention relates to a control method for controlling a fuel injection system (10) of an internal combustion engine, wherein, wherein, in a fault situation of the fuel injection system (10), a camshaft angle of a camshaft (34) which drives a pump piston (32) of a high-pressure fuel pump (14) of the fuel injection system (10) is adjusted such that an injection time (tI) of injector valve (42) which injects the fuel from the fuel injection system (10) into a combustion chamber of the internal combustion engine lies in a pressure trough (50) of a pressure oscillation in a high-pressure region (16).

16 Claims, 7 Drawing Sheets

(51) Int. Cl.

| | |
|---|---|
| ***F02D 41/38*** | (2006.01) |
| ***F02M 63/02*** | (2006.01) |
| *F02M 63/00* | (2006.01) |
| *F02D 41/12* | (2006.01) |

(52) U.S. Cl.
CPC ..... *F02D 41/3836* (2013.01); *F02D 41/3845* (2013.01); *F02D 41/3863* (2013.01); *F02M 59/025* (2013.01); *F02M 59/027* (2013.01); *F02M 63/0245* (2013.01); *F02D 41/123* (2013.01); *F02D 2041/223* (2013.01); *F02D 2041/224* (2013.01); *F02D 2200/0602* (2013.01); *F02D 2250/04* (2013.01); *F02M 59/02* (2013.01); *F02M 63/005* (2013.01)

(58) Field of Classification Search
CPC ..... F02D 41/3836; F02D 41/3845; F02D 2041/223; F02D 2041/224
USPC ..... 123/459, 506, 508, 690
See application file for complete search history.

(56) References Cited

U.S. PATENT DOCUMENTS

| | | | | |
|---|---|---|---|---|
| 2011/0125387 | A1* | 5/2011 | Suzuki | F02D 41/126 701/103 |
| 2016/0153366 | A1* | 6/2016 | Steinert | F02M 63/0245 123/457 |

FOREIGN PATENT DOCUMENTS

| | | | |
|---|---|---|---|
| EP | 1281860 | A2 | 2/2003 |
| EP | 2071167 | A1 | 6/2009 |
| EP | 2187029 | A1 | 5/2010 |
| EP | 2432983 | A1 | 3/2012 |
| JP | 2009270510 | | 11/2009 |
| JP | 2010169022 | A | 8/2010 |
| JP | 2012202404 | A | 10/2012 |
| JP | 2012229623 | A | 11/2012 |

* cited by examiner

CONTROL METHOD FOR CONTROLLING A FUEL INJECTION SYSTEM, AND FUEL INJECTION SYSTEM

FIELD OF INVENTION

The invention relates to a control method with which a fuel injection system of an internal combustion engine can be operated, and to a fuel injection system which is suitable in particular for carrying out the control method.

BACKGROUND

Fuel injection systems, for example gasoline direct injection systems, have, in simplified terms, a high-pressure fuel pump, by means of which a fuel is highly pressurized, and a high-pressure region with a high-pressure accumulator, the so-called rail, and with at least one injector valve for injecting the highly pressurized fuel into an associated combustion chamber of an internal combustion engine. The stated components are connected to one another by means of high-pressure lines.

For the operation of the fuel injection system, a control device, the so-called ECU, with corresponding software is normally provided. By means of the control device, it is for example possible for the delivery power of the high-pressure fuel pump to be adapted. For this purpose, on the high-pressure fuel pump, for example, there is situated a valve, which may be formed for example as a so-called digital inlet valve. Said digital inlet valve may for example be provided in a "currentless open" embodiment, that is to say open when electrically deenergized, though other embodiments are also possible and known. Furthermore, for the regulation of the injection pressure required at the injector valves, a high-pressure sensor is situated in the fuel injection system, which high-pressure sensor is normally attached to the high-pressure accumulator and serves for acquiring the so-called system pressure. In the case of gasoline as fuel, said system pressure typically lies in a range between 150 bar and 500 bar, and in the case of diesel as fuel, said system pressure typically lies in a range between 1500 bar and 3000 bar. Pressure regulation by acquisition of a signal of the high-pressure sensor, processing of the signal by means of the control device and alteration of the delivery power of the high-pressure fuel pump by means of the digital inlet valve is normally performed. The high-pressure fuel pump is normally mechanically driven by the internal combustion engine itself, for example by means of a camshaft.

In the described high-pressure fuel pumps with a digital inlet valve, faults may arise which lead to an undesirably increased delivery power of the high-pressure fuel pump. This may for example be caused by the inlet valve on the high-pressure fuel pump no longer being able to be fully opened or closed. It is for example also conceivable that, for example as a result of a spring breakage at a spring in the inlet valve, or further possible faults, the delivery power can no longer be controlled.

In such a fault situation, a volume flow for the high-pressure fuel pump is set in a manner dependent on the rotational speed of the internal combustion engine and the temperature prevailing in the fuel injection system. Here, said volume flow may be greater than the injection quantity of the at least one injector valve. For example, in a typical operating state, the so-called overrun mode of the internal combustion engine, no or only little injection is performed through the injector valve. Therefore, if the high-pressure fuel pump delivers an excessively large volume flow, an undesired pressure increase occurs in the fuel injection system.

To be able to deplete undesirably high pressures in the high-pressure region of the fuel injection system, it is common for a mechanical safety valve, a so-called pressure-limiting valve, to be provided on the high-pressure fuel pump, which valve can limit or restrict the pressure.

Typical p-Q characteristics of the pressure-limiting valve are configured such that a maximum pressure takes effect in the high-pressure accumulator, which maximum pressure exceeds the nominal pressures of the injector valve during normal operation.

After the fault situation, the pressure increases within a few pump strokes of the high-pressure fuel pump up to a maximum pressure, which takes effect in the high-pressure region.

The pressure-limiting valve is commonly designed so as to discharge into a pressure chamber of the high-pressure fuel pump, such that said pressure-limiting valve is hydraulically blocked during a delivery phase of the high-pressure fuel pump. This means that the pressure-limiting valve can open, and discharge fuel out of the high-pressure region, exclusively in the suction phase of the high-pressure fuel pump. Such pressure-limiting valves are referred to as hydraulically blocked pressure-limiting valves.

Owing to the structural nature of the injector valve, the injector valve commonly opens counter to the pressure prevailing in the high-pressure accumulator. Here, in a manner dependent on the operating state of the internal combustion engine, an actuation profile is used for the actuation of the injector valve in order to open the injector valve such that an injection can begin.

Many injector valves are designed not for the maximum pressure in the fault situation but, in a cost-optimized manner, for normal operation. In this way, in fault situations with excessively high pressures in the high-pressure region, the injector valve can no longer open, and the internal combustion engine can thus no longer operate. This can result in a breakdown of a vehicle operated with the internal combustion engine.

SUMMARY

It is therefore an object of the invention to propose a control method for operating a fuel injection system, and a corresponding fuel injection system, by means of which a failure of the internal combustion engine can be prevented even in a fault situation.

This object is achieved by a control method having the features of independent claim 1.

The coordinate claim relates to a fuel injection system which is designed in particular for carrying out the control method.

Advantageous configurations of the invention are the subject of the dependent claims.

In a control method for controlling a fuel injection system of an internal combustion engine, it is firstly the case that a fuel injection system is provided, which has a high-pressure fuel pump with a pump piston which moves between a bottom dead center and a top dead center in a pressure chamber during operation and which serves for highly pressurizing a fuel, a camshaft for driving the pump piston, and a high-pressure region with at least one injector valve which serves for injecting highly pressurized fuel into a combustion chamber of an internal combustion engine.

Furthermore, a pressure-limiting valve is provided which, when a predefined opening pressure is reached in the high-pressure region, discharges fuel from the high-pressure region into the pressure chamber of the high-pressure fuel pump. A fault situation in the fuel injection system is detected, wherein the fault situation lies in the fact that the predefined opening pressure is overshot in the high-pressure region. Furthermore, a period duration with four evenly distributed quadrants is determined between a first TDC time, at which the pump piston is at the top dead center, and a second TDC time, at which the pump piston is at the top dead center. An injection time at which the injector valve begins to inject fuel is set. A camshaft adjuster is provided in the fuel injection system for the purposes of enabling a camshaft angle of the camshaft relative to the pump piston to be adjusted. After the injection time is set, the camshaft angle of the camshaft is adjusted such that the injection time lies in a duration which extends in a second quadrant of the period duration and/or in a third quadrant of the period duration.

In the fault situation, the pressure in the high-pressure region increases continuously within a few strokes of the pump piston. In this case, the pressure-limiting valve discharges fuel from the high-pressure region into the pressure chamber of the high-pressure fuel pump, but is hydraulically locked in the delivery phase of the high-pressure fuel pump, such that the pressure in the high-pressure region increases at this time, and falls again when the pressure-limiting valve is opened. In the fault situation, therefore, a pressure oscillation forms in the high-pressure region, with pressure troughs, specifically when the pressure-limiting valve can discharge fuel into the pressure chamber, and pressure peaks, when the pressure-limiting valve is hydraulically blocked. Here, the pressure troughs correspond to bottom dead centers of the pump piston, whereas the pressure peaks correspond to top dead centers of the pump piston. The time at which the pump piston is situated at the top dead center or at the bottom dead center respectively is dependent on a camshaft angle of the camshaft relative to the pump piston. If this camshaft angle is adjusted, the time at which the pump piston is situated at the top dead center or at the bottom dead center respectively changes. If it is now set in a predefined manner when an injector valve is to inject fuel into a combustion chamber, it is possible, through adjustment of the camshaft angle of the camshaft relative to the pump piston, for a pressure trough to be set at a time such that the injection time of the injector valve falls exactly into said pressure trough. For this purpose, it must initially be determined beforehand how the period duration, that is to say a duration between two adjacent top dead centers of the pump piston, is formed. Said period duration is then divided into four equally sized quadrants. Here, a pressure trough is situated exactly between the second quadrant and the third quadrant. The camshaft angle is adjusted such that the pressure trough and thus the second and third quadrant come to lie, in terms of time, such that the injection time is situated therein.

Therefore, if the high-pressure fuel pump is driven mechanically by means of a camshaft, wherein the camshaft exhibits an adjustment of the camshaft angle, for example by means of a camshaft adjuster, which may be hydraulically or electrically driven, then in the event of a fault situation being detected, the camshaft is adjusted such that the injection time falls into the negative amplitude, that is to say into the pressure trough of the pressure oscillation in the high-pressure region. In this way, the injector valve can still open even if the averaged pressure in the high-pressure region is above a pressure critical for the injector opening.

In an advantageous embodiment, the fault situation is detected by means of a high-pressure sensor arranged in the high-pressure region. Such high-pressure sensors are provided in the high-pressure region of the fuel injection system in any case and can therefore be used as signal transmitters for the control of the fuel injection system in the fault situation.

The opening pressure of the pressure-limiting valve is advantageously set to be lower than a maximum admissible maximum pressure in the high-pressure region. Here, the maximum pressure is to be understood to mean a pressure in the high-pressure region counter to which the injector valves can still just open. For example, the maximum pressure may be defined in a range above 500 bar. It is advantageous for the opening pressure of the pressure-limiting valve to be considerably lower than this, in order to thereby prevent a maximum pressure from forming in the high-pressure region in the first place. Advantageous pressure ranges of the opening pressure of the pressure-limiting valve lie in this case in a range between 300 bar and 400 bar, wherein the opening pressure already exceeds the nominal pressures in the normal mode of the injector valves. Said nominal pressures normally lie in a range between 200 bar and 280 bar.

Preferably, the injection time is set in a manner dependent on a fuel demand from the internal combustion engine. That is to say that fuel is injected only when the internal combustion engine actually requires fuel for the operation thereof.

Advantageously, upon a detection of re-entry into a normal mode of the fuel injection system in which the predefined opening pressure is undershot again in the high pressure region, the adjustment of the camshaft is ended in a manner dependent on the set injection time.

In an advantageous refinement, a characteristic map is stored, which assigns every camshaft angle of the camshaft relative to the pump piston a predetermined TDC time. It is therefore possible to adjust the camshaft angle in targeted fashion if the four quadrants of the period duration are known in terms of their temporal position.

In an advantageous configuration, at least two operating states of the internal combustion engine are provided, wherein, in an overrun mode, no injection of fuel through the injector valve into the combustion chamber takes place, wherein, in an injection mode, at least one injection of fuel through the injector valve into the combustion chamber takes place. In the fault situation, the overrun mode of the internal combustion engine is deactivated, such that the internal combustion engine is operated exclusively in the injection mode. In this way, the opening capability of the injector valve can be additionally assisted, because phases are avoided in which no fuel whatsoever is extracted from the high-pressure region and thus the pressure in the high-pressure region could build up further. In general, the fault situation is not relevant to the exhaust gas, and a possible power loss is acceptable in the fault situation, because in this way, it is basically possible to prevent failure of the internal combustion engine and a breakdown of a vehicle operated with the internal combustion engine.

When the overrun mode is deactivated, it is advantageous if such a quantity of fuel is injected through the injector valve in the injection mode that a high pressure which is lower than the maximum pressure and which altogether advantageously corresponds to an opening pressure of the pressure-limiting valve is set in the high-pressure region. As a result, the injector valves can continue to be reliably opened.

A fuel injection system for injecting fuel into combustion chambers of an internal combustion engine is designed in particular for carrying out the control method described above. Here, the fuel injection system has a high-pressure fuel pump with a pump piston which moves between a bottom dead center and a top dead center in a pressure chamber during operation and which serves for highly pressurizing a fuel. Furthermore, a camshaft is provided which serves for driving the pump piston and which has a camshaft adjuster for the adjustment of a camshaft angle of the camshaft relative to the pump piston. Furthermore, the fuel injection system comprises a high-pressure region with at least one injector valve for injecting highly pressurized fuel into a combustion chamber of the internal combustion engine. Furthermore, a pressure-limiting valve is provided which is arranged in the high-pressure region and which is designed to, when a predefined opening pressure is reached in the high-pressure region, discharge a fuel from the high-pressure region into the pressure chamber of the high-pressure fuel pump. Furthermore, the fuel injection system comprises a control device which is designed to detect a fault situation in the fuel injection system, wherein the fault lies in the fact that the predefined opening pressure is overshot in the high-pressure region. Furthermore, the control device is designed to determine a period duration with four evenly distributed quadrants between a first TDC time, at which the pump piston is at the top dead center, and a second TDC time, at which the pump piston is at the top dead center. The control device is furthermore designed to set an injection time at which the injector valve begins to inject fuel, and to adjust the camshaft angle of the camshaft such that the injection time lies in a duration which extends in a second quadrant of the period duration and/or in a third quadrant of the period duration.

BRIEF DESCRIPTION OF THE DRAWINGS

Advantageous configurations of the invention will be discussed in more detail below on the basis of the appended drawings, in which.

DETAILED DESCRIPTION

Figure 1:
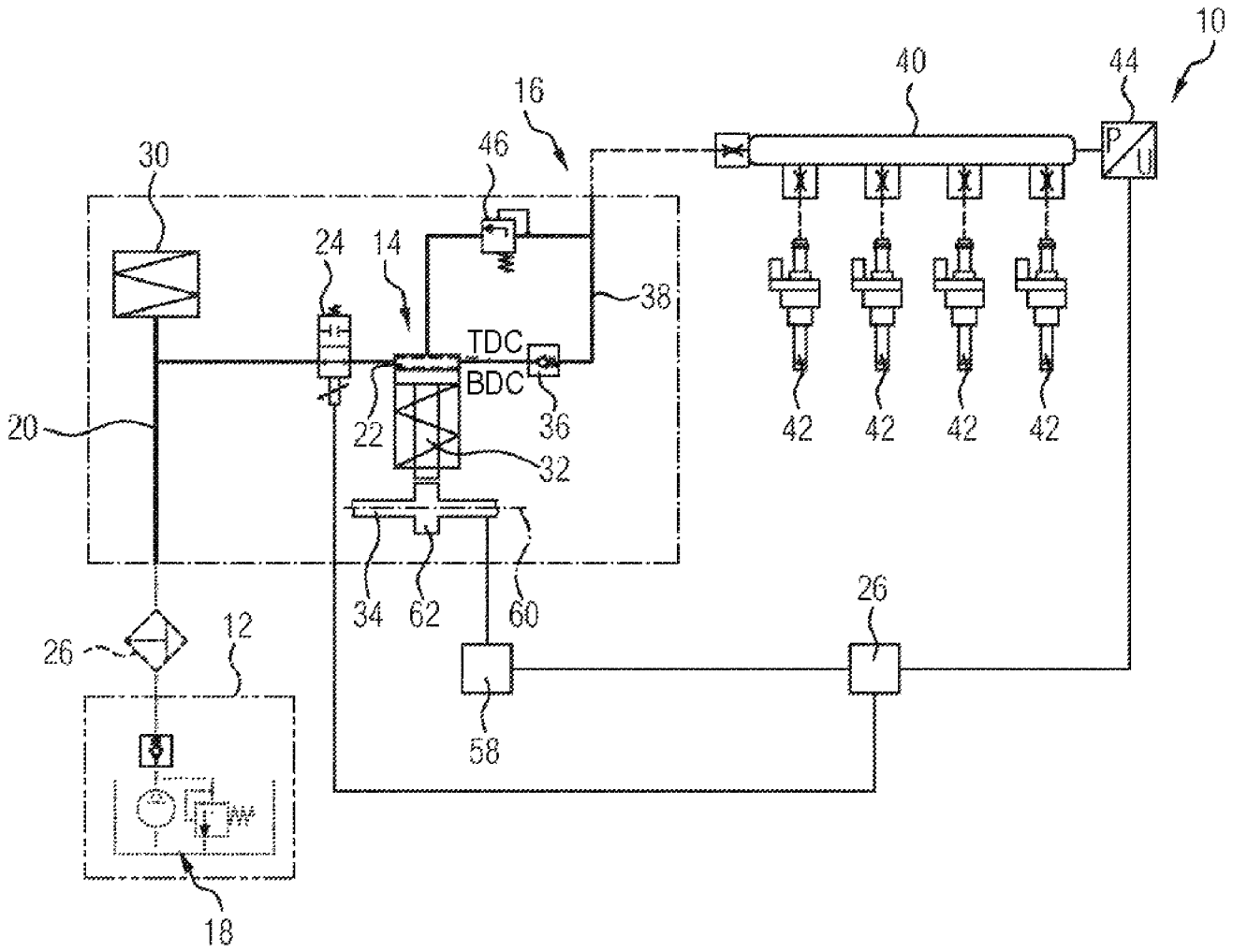
FIG. 1 is a schematic illustration of a fuel injection system for injecting fuel into combustion chambers of an internal combustion engine.

FIG. 1 shows a fuel injection system 10 by means of which fuel can be injected into combustion chambers of an internal combustion engine. For this purpose, the fuel injection system 10 has a fuel accumulator 12 such as for example a tank, a high-pressure fuel pump 14, and a high-pressure region 16 situated downstream of the high-pressure fuel pump 14. From the fuel accumulator 12, fuel is pumped for example by means of a tank pump 18 into a low-pressure line 20 and is thus delivered to a pressure chamber 22 of the high-pressure fuel pump 14. To be able to regulate a delivery power of the high-pressure fuel pump 14, a digital inlet valve 24 is connected upstream of the pressure chamber 22 in the low-pressure line 20. Said digital inlet valve 24 may be actuated by a control device 26 in order to regulate the fuel quantity that is highly pressurized by the high-pressure fuel pump 14 in the pressure chamber 22. Additional elements such as filters 28 and an evaporator 30 are arranged in the low-pressure line 20 in order to purify the fuel from the fuel regulator 12 and also dampen pulsation damping actions in the low-pressure line 20.

A pump piston 32 moves in translational fashion back and forth in the pressure chamber 22, and in so doing increases and decreases the volume of the pressure chamber 22. The pump piston 32 is driven in its translational movement by a camshaft 34. Here, the camshaft 34 is coupled for example to a crankshaft of the internal combustion engine and is thus driven by the internal combustion engine itself. During the movement of the pump piston 32 in the pressure chamber 22, the pump piston 32 reaches a top dead center TDC at the moment at which the pressure chamber 22 has its smallest volume, and reaches a bottom dead center BDC at the moment at which the pressure chamber 22 reaches its largest volume. The corresponding times are thus the TDC time and the BDC time.

Highly pressurized fuel is then released via an outlet valve 36 from the high-pressure fuel pump 14 into the high-pressure region 16 and is conducted via a high-pressure line 38 to a pressure accumulator 40, in which the highly pressurized fuel is stored until it is injected via injector valves 42, which are arranged on the pressure accumulator 40, into combustion chambers of an internal combustion engine.

To regulate the delivery power of the high-pressure fuel pump 14, there is arranged on the pressure accumulator 40 a high-pressure sensor 44 which monitors the pressure prevailing in the pressure accumulator 40. The high-pressure sensor 40 transmits a signal to the control device 26, which then actuates the inlet valve 24 in a manner dependent on this signal, such that the high pressure in the pressure accumulator 40 can be regulated.

In a fault situation, it may be the case that the high-pressure fuel pump 14 has an increased delivery power, and thus a pressure is generated in the pressure accumulator 40 which is much higher than a normal pressure during normal operation. For this situation, a pressure-limiting valve 46 is provided on the high-pressure line 38, which pressure-limiting valve discharges fuel from the high-pressure region 16 in order to thereby lower the pressure in the high-pressure region 16. Here, the pressure-limiting valve 46 discharges the fuel into the pressure chamber 22 of the high-pressure fuel pump 14. Since the pressure-limiting valve 46 is normally formed as a check valve, the pressure-limiting valve 46 is hydraulically locked when the high-pressure fuel pump 14 is in the delivery phase, that is to say when fuel in the pressure chamber 22 is highly pressurized and is then discharged via the outlet valve 36 into the high-pressure region 16. However, if the high-pressure fuel pump 14 is situated in a suction phase, the pump piston 32 moves towards its bottom dead center BDC, the volume in the pressure chamber 22 is expanded, and the pressure-limiting valve 46 can open and discharge fuel into the pressure chamber 22.

Here, an opening pressure $P_{open}$ is set so as to be lower than a maximum admissible maximum pressure $P_{max}$ in the high pressure region 16 at which it is still just possible for the injector valves 42 to open counter to said high pressure and inject fuel into the combustion chambers. For example, such a maximum pressure $P_{max}$ lies above 500 bar. The opening pressure $P_{open}$ of the pressure-limiting valve 46 is thus advantageously set in a range between 300 bar and 500 bar. This exceeds the nominal pressures of approximately 250 bar during normal operation, in the case of which the injector valves 42 can be operated without problems.

In a fault situation as described above, for example as a result of a spring breakage at the inlet valve 24 or other fault situations that prevent regulation of the pump delivery power, the high-pressure fuel pump 14 passes into the state of so-called full delivery, and delivers fuel unhindered into the high-pressure region 16. Since the pressure-limiting valve 46 can discharge the fuel into the pressure chamber 22 only during the suction phase of the high-pressure fuel pump 14, the high pressure in the high-pressure region 16 increases within a few pump strokes to a maximum which takes effect.

This will be briefly discussed with reference to the diagram in FIG. 2. Here, the diagram illustrates a pressure-time diagram, wherein a pressure p in the high-pressure region 16 is plotted versus a time t in which the high-pressure fuel pump 14 performs pump strokes.

Here, the fault situation occurs at a time $t_1$. As can be seen, the pressure p in the high-pressure region 16 increases continuously after this time $t_1$ until the opening pressure $P_{open}$ of the pressure-limiting valve 46 is reached at a time $t_2$.

Figure 2:
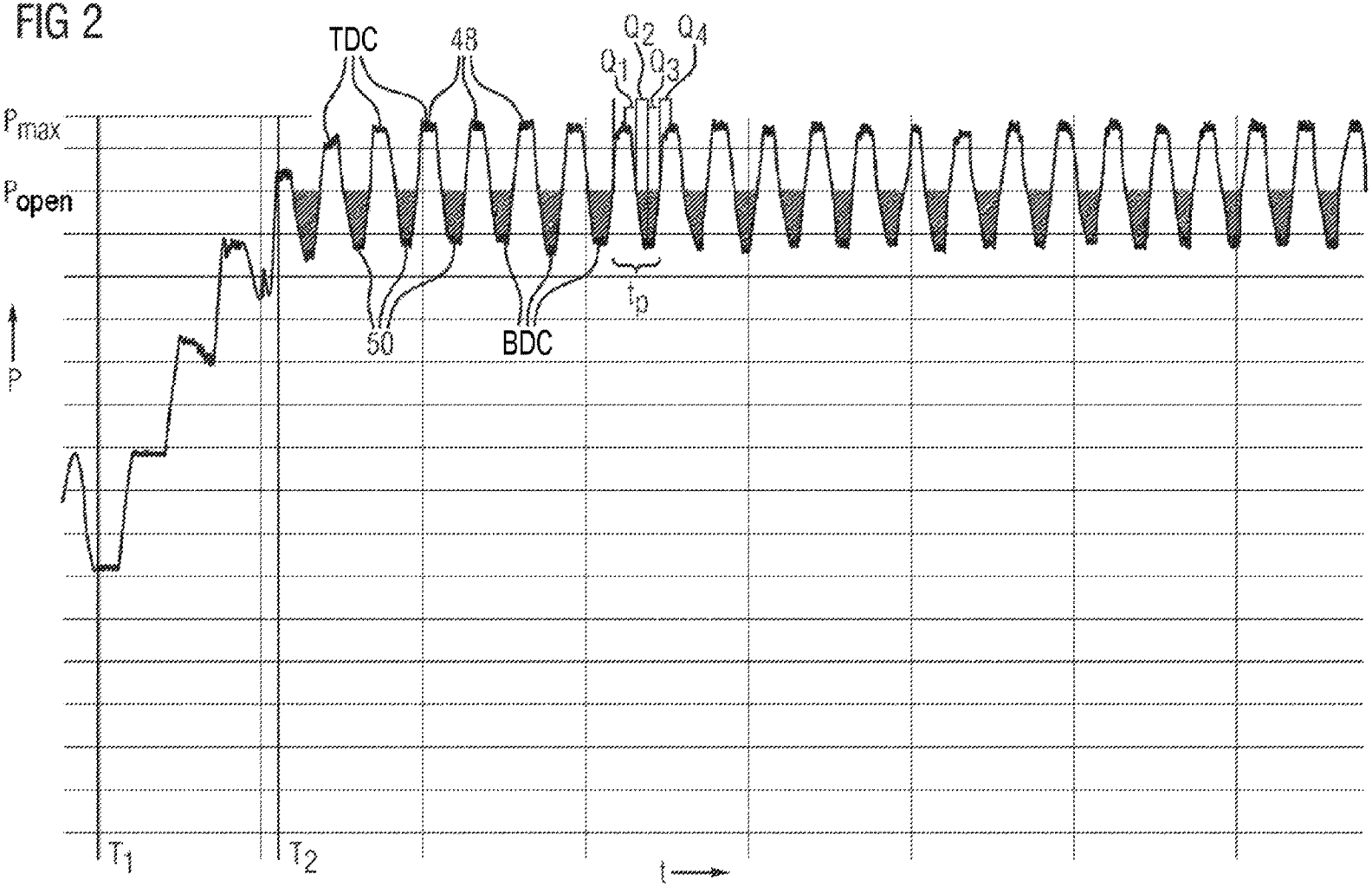
FIG. 2 shows a pressure-time diagram which illustrates a pressure oscillation in a high-pressure region of the fuel injection system from FIG. 1 in a fault situation.

Here, the diagram in FIG. 2 shows the pressure build-up after a fault situation in which the high-pressure fuel pump 14 is set into a full delivery position. The speed with which the opening pressure $P_{open}$ of the pressure-limiting valve 46 is reached is dependent on the rotational speed of the high-pressure fuel pump 14, which is dependent on a rotational speed of the crankshaft of the internal combustion engine. Furthermore, the pressure increase is also dependent on the temperature in the fuel injection system 10. Here, FIG. 2 illustrates a situation in which the internal combustion engine is in the overrun mode, that is to say in an operating state in which no injection of fuel through the injector valve 42 into the combustion chamber occurs.

Since the pressure-limiting valve 46 can discharge into the pressure chamber 22 only when the pressure in the pressure chamber 22 is lower than in the high-pressure region 16, a pressure oscillation occurs in the high-pressure region 16, which is distinguished by the fact that, during the discharging of the pressure-limiting valve 46, the high pressure in the high-pressure region 16 falls and then increases again if the pressure-limiting valve 46 is hydraulically blocked. Owing to the embodiment of the pressure-limiting valve 46 as a hydraulically blocked pressure-limiting valve, the characteristic shown in FIG. 2 is thus realized, with pressure peaks 48 when the high-pressure fuel pump 14 is in the delivery phase and with pressure troughs 50 when the high-pressure fuel pump 14 is in the suction phase.

If a fault situation arises which leads to overdelivery or full delivery of the high-pressure fuel pump 14, the maximum pressure in the pressure accumulator 40 therefore increases, in particular in the overrun mode or in operating states with a low injection quantity, in a manner dependent on the present rotational speed of the internal combustion engine and the temperature in the fuel injection system 10. In the case of pressures higher than the maximum admissible injector opening pressure $P_{max}$, misfiring of the internal combustion engine or even a breakdown of a vehicle operated with the internal combustion engine can occur.

To prevent the pressure that prevails at the injector valves 42 from increasing beyond the maximum pressure $P_{max}$ at which the injector valves 42 still open, the methods described below can be carried out. Below, three different methods will be described, which can be implemented as countermeasures; the methods may be implemented in each case individually or in combination. The control device 26 is in each case designed to carry out each of said methods. If the methods are carried out simultaneously, the control device 26 is configured correspondingly.

Below, however, for the sake of clarity, the methods will be described only as methods to be carried out individually.

A first countermeasure with which a shutdown of the internal combustion engine can be prevented is in this case a so-called overrun deactivation, which will be described below with reference to FIG. 3 and FIG. 4.

Figure 3:
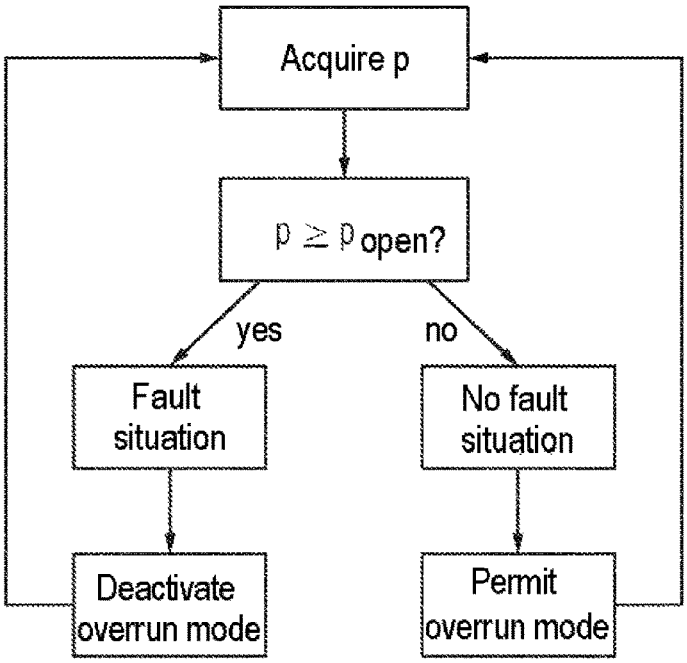
FIG. 3 shows a flow diagram which schematically illustrates an operating method for operating the fuel injection system from FIG. 1 in the fault situation, in a first embodiment.
Figure 4:
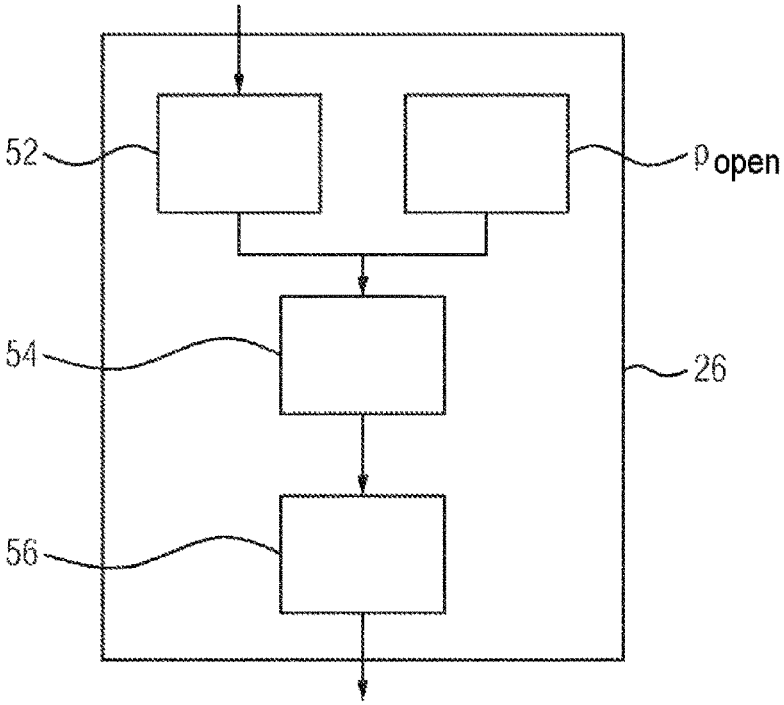
FIG. 4 is a schematic illustration of a control device which is designed for carrying out the operating method as per FIG. 3.

Here, FIG. 3 schematically shows, on the basis of a flow diagram, the steps of an operating method with which such overrun deactivation can be implemented, whereas FIG. 4 schematically shows the control device 26 that is configured for carrying out the operating method as per FIG. 3.

The internal combustion engine is operated by the control device 26 in at least two operating states, specifically in an overrun mode and in an injection mode. Here, in the overrun mode, no fuel is injected via the injector valves 42 into the combustion chambers of the internal combustion engine, whereas, in the injection mode, at least one injection of fuel through the injector valves 42 into the combustion chambers occurs.

In the operating method, in a first step, a pressure p in the high-pressure region 16 is firstly acquired by means of the high-pressure sensor 44. For this purpose, the control device 26 has a pressure acquisition device 52, which communicates with the high-pressure sensor 44. The opening pressure $P_{open}$ of the pressure-limiting valve 46 is also stored in the control device 26.

In a subsequent step of the operating method, it is therefore determined, by means of a fault detection device 54 of the control device 26, whether the pressure p is higher than or equal to the opening pressure $P_{open}$ of the pressure-limiting valve 46. If this is the case, the fault detection device 54 detects that a fault situation is present. In this case, the overrun mode of the internal combustion engine is deactivated by an overrun deactivation device 56 in the control device 26. This means that an overrun deactivation of the injector valves 42, such that they inject no further fuel into the internal combustion engine, is prohibited, and only fired overrun, that is to say the injection mode of the internal combustion engine, is permitted by the control device 26. It is thereby ensured that always a certain fuel quantity is discharged via the injector valves 42 and thus extracted from the high-pressure region 16. The pressure level in the high-pressure region 16 is in this case kept below the critical pressure $P_{max}$ for the injector opening, and is preferably even lowered to such an extent as to lie in the range of the opening pressure $P_{open}$ of the pressure-limiting valve 46.

After detection of the fault situation that leads to the uncontrolled delivery by the high-pressure fuel pump 14, therefore, the overrun mode, in which no fuel is injected, is prohibited, and instead, only an operating state with an at least small injection quantity is permitted and also implemented. The corresponding function is in this case stored in the control device 26.

If it is however identified in the operating method that the pressure p in the high-pressure region 16 is not higher than or equal to the opening pressure $P_{open}$ of the pressure-limiting valve 46, the fault detection device 54 identifies that no fault situation is present, and the overrun mode of the internal combustion engine remains permitted. Both after permission of the overrun mode and after deactivation of the overrun mode, it is always the case that the pressure p in the high-pressure region 16 is acquired again and it is checked whether said pressure is higher than or equal to the opening pressure $P_{open}$ of the pressure-limiting valve 46.

If the situation arises in which, after deactivation of the overrun mode, the pressure p in the high-pressure region 16 has fallen below the opening pressure $P_{open}$, the fault detection device 54 detects that the fuel injection system 10 has entered a normal mode again. In this case, the overrun mode can then be reactivated. This means that the functionality can be optionally withdrawn again in a manner dependent on the pressure conditions in the fuel injection system 10.

Altogether, by means of the operating method, the risk of a breakdown of a vehicle operated with the internal combustion engine is reduced. Here, the fault situation is not relevant to the exhaust gas. A possible power loss is acceptable in the fault situation.

An actuation method for actuating the fuel injection system 10, which may be carried out alternatively or in addition to the overrun deactivation described above, will be described below with reference to FIG. 5 and FIG. 6. Here, a camshaft angle of the camshaft 34 relative to the pump piston 32 is adjusted in targeted fashion by means of a camshaft adjuster 58 provided in the fuel injection system 10.

The camshaft 34 rotates about a camshaft axis 60, wherein, at regular intervals, a cam 52 comes into contact with the pump piston 32 such that the pump piston 32 is moved toward the top dead center TDC. As the camshaft 34 rotates onward, the cam 62 moves away from the pump piston 32 again, and the pump piston 32 moves in the direction of the bottom dead center BDC. Therefore, in periodic intervals, the pump piston 32, moved by the cam 62, is situated alternately at the top dead center TDC and at the bottom dead center BDC. However, if an angle between pump piston 32 and the camshaft 34 is adjusted during the operation of the camshaft 34, the spacing between two successive top dead centers TDC is no longer uniform, as illustrated for example in the diagram shown in FIG. 2, it rather being the case that the TDC time of the top dead center TDC changes.

The adjustment of the angle of the camshaft 34 may likewise be induced by means of the control device 26, by means of a cam angle adjustment device 64 arranged in the control device 26.

If an injection time $t_I$ at which the injector valves 42 begin the injection of fuel into the combustion chambers is known, for example by virtue of an opening time $t_{open}$ for the injector valves 42 being set by means of an opening time setting device 66 in the control device 26, the camshaft 34 can be adjusted by means of the camshaft angle adjustment device 64 such that the injection time $t_I$ is situated in the pressure trough shown in FIG. 2.

Figure 5:
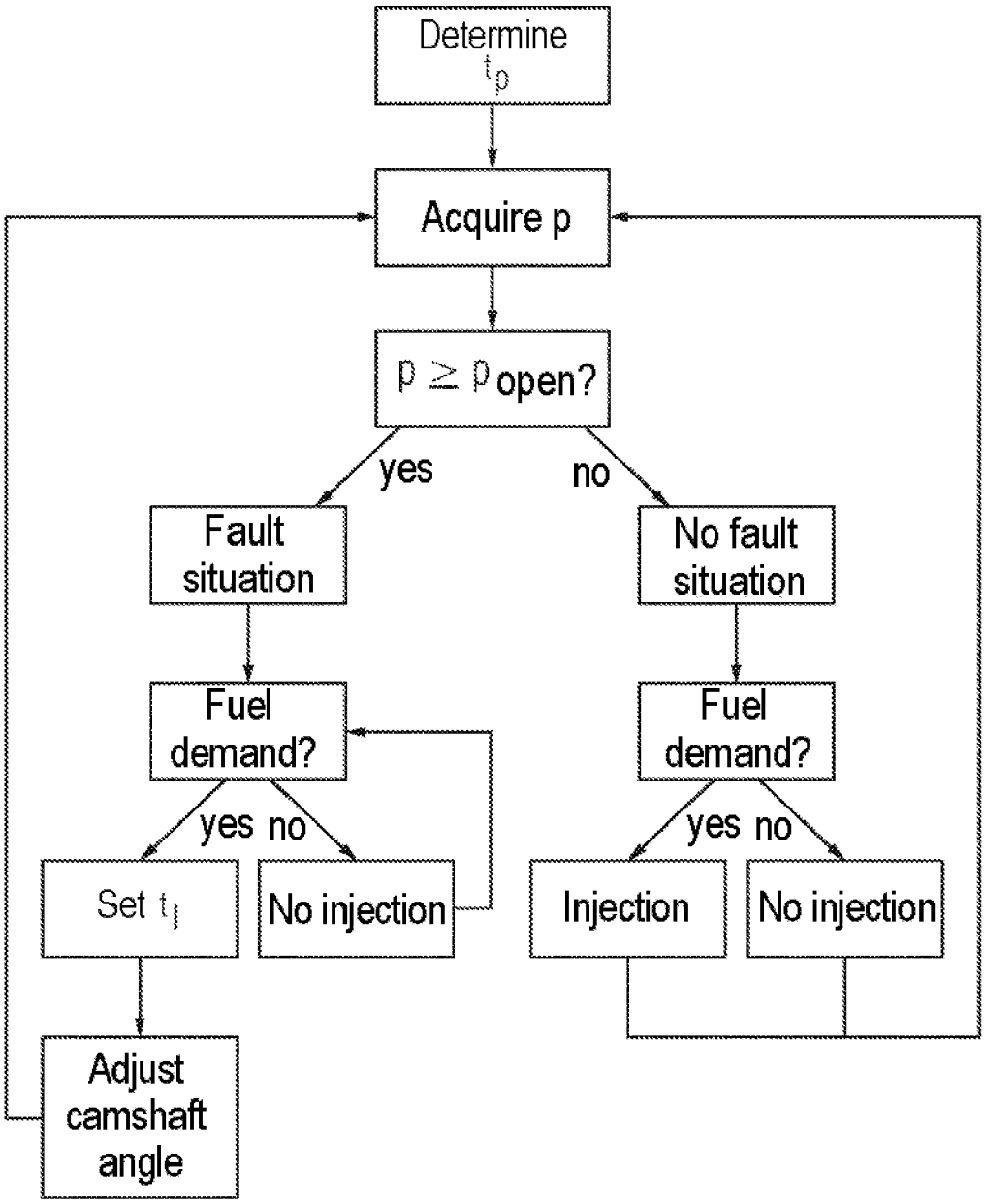
FIG. 5 shows a flow diagram which schematically illustrates an actuation method for the actuation of the fuel injection system from FIG. 1 in a fault situation, in a second embodiment.
Figure 6:
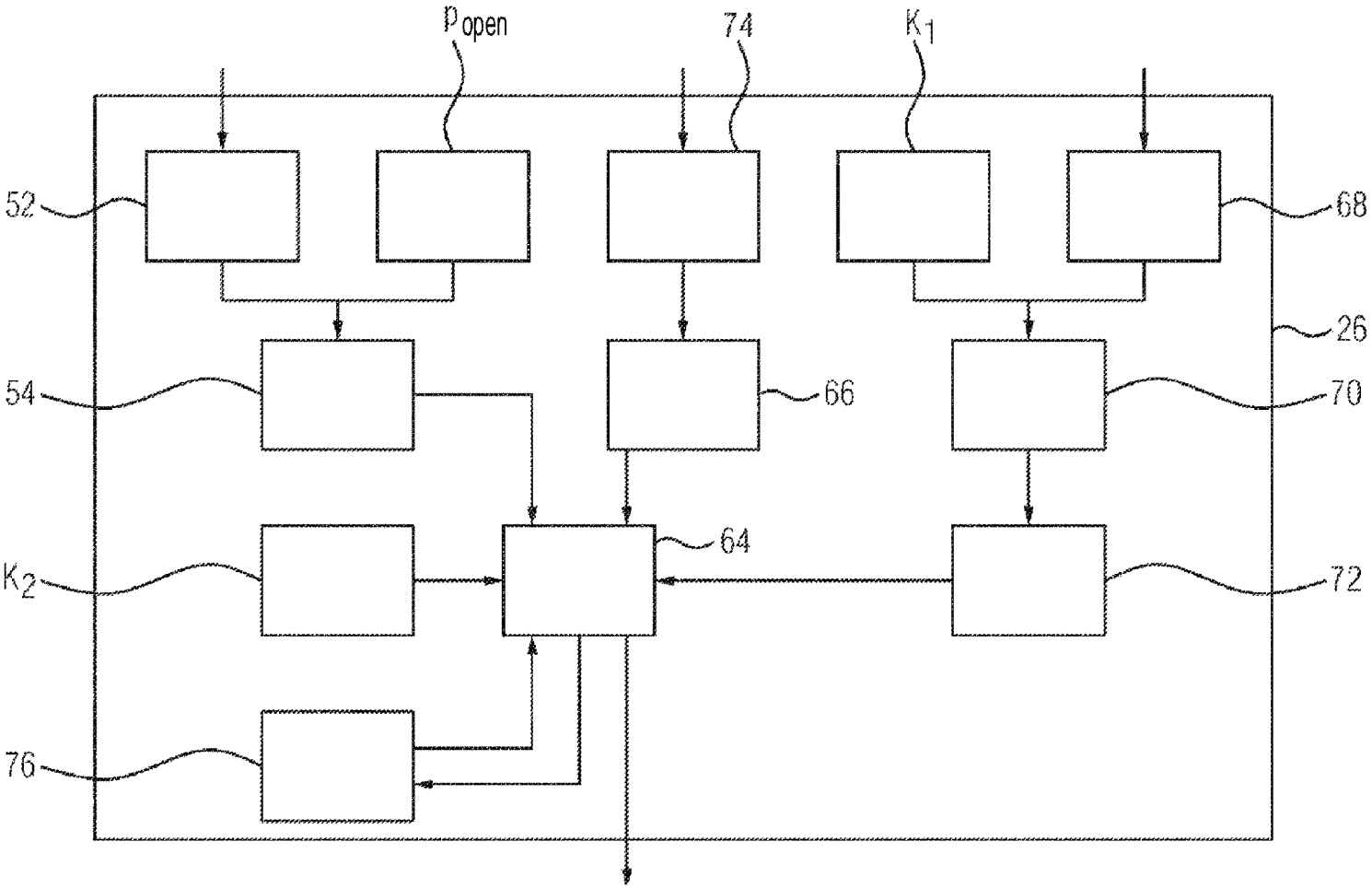
FIG. 6 is a schematic illustration of a control device which is designed for carrying out the actuation method as per FIG. 5.

For this purpose, as per the flow diagram in FIG. 5, it is firstly the case that a period duration $t_p$ of the pressure oscillation in the high-pressure region 16 is determined. Here, the period duration $t_p$ corresponds to a duration between the time at which the pump piston 32 reaches a first top dead center TDC and a time at which the pump piston 32 next reaches a top dead center. Owing to the mechanical connection of the high-pressure fuel pump 14 to the internal combustion engine, the position of the camshaft 34 and thus of the top dead center TDC of the pump piston 32 are known and are stored in a first characteristic map K1 in the control device 26, wherein the characteristic map K1 assigns every crankshaft angle a position of the pump piston 32. Also arranged in the control device 26 is a crank angle acquisition device 68 by means of which the control device 26 can acquire the present crankshaft angle. A TDC detection device 70 can therefore, from the data of the first characteristic map K1 and the data of the crankshaft acquisition device 68, detect when the pump piston 32 is situated at a top dead center TDC. This information is fed to an evaluation device 72 which is arranged in the control device 26 and which, from said information, determines the period duration $t_p$. Furthermore, the evaluation device 72 divides the period duration TP into four evenly distributed quadrants Q1, Q2, Q3 and Q4.

In the actuation method, it is subsequently, analogously to the overrun deactivation, identified whether a fault situation is present in the fuel injection system 10. If a fault situation is present, there is firstly a waiting period until a fuel demand detection device 74 detects whether a fuel demand from the internal combustion engine is present, that is to say whether an injection via the injector valves 42 is required. If this is the case, the injection time $t_I$ is firstly set to an arbitrary time. Then, by means of the camshaft adjuster 58, which is driven by the camshaft angle adjustment device 64, an angle of the camshaft relative to the pump piston 32 is adjusted such that the previously set injection time $t_I$ falls into the pressure trough of the pressure oscillation from FIG. 2, that is to say into the duration of the second quadrant Q2 or of the third quadrant Q3.

However, if no fuel demand is present, no injection via the injector valves 42 is performed.

To be able to adjust the camshaft angle in targeted fashion, a second characteristic map K2 is stored in the control device 26, which second characteristic map assigns every camshaft angle of the camshaft 34 relative to the pump piston 32 a predetermined time at which the pump piston 32 is situated at the top dead center TDC. Also arranged in the control device 26 is a memory device 76 which stores the present camshaft angle. The data of the characteristic map K2 and of the memory device 76 are fed to the camshaft angle adjustment device 64, in order that the camshaft angle can be adjusted in targeted fashion. Furthermore, the camshaft angle adjustment device 64 outputs a signal to the camshaft adjuster 58 only if the information regarding when the injection through the injector valves 42 is supposed to start is present, that is to say when the injection time $t_I$ has been set. The camshaft adjuster 58 adjusts the angle of the camshaft 34 only when a fault situation is actually present, wherein the camshaft angle adjustment device 64 is additionally fed with the information from the evaluation device 72 as regards where the pressure trough 50 is presently situated.

If the fault detection device 54 identifies that no fault situation is present, and if the fuel demand detection device 74 detects that fuel is demanded by the internal combustion engine, fuel is injected entirely normally via the injector valves 42 into the respective combustion chambers. In the absence of a fuel demand, however, the injector valves 42 do not open.

The method in which the camshaft angle is adjusted in order to thereby shift the injection time $t_I$ into a pressure trough 50 is also carried out continuously in order to thereby detect whether the fuel injection system 10 has entered a normal mode and the pressure p in the high-pressure region 16 lies below the opening pressure $P_{open}$ again. In this case, the adjustment of the camshaft 34 is ended in a manner dependent on the set injection time $t_I$.

Therefore, if the high-pressure fuel pump 14 is mechanically driven by means of a camshaft 34 which exhibits a means for adjusting the angle, that is to say a so-called camshaft adjuster 58, which may be hydraulically or electrically operated, then in the event of a fault situation being detected, the camshaft 34 is adjusted by means of the camshaft adjuster 58 such that the start of injection, that is to say the injection time $t_I$, falls into the negative amplitude, that is to say into the pressure trough 50, of the rail pressure oscillation as per FIG. 2. Therefore, the injector valves 42 can still open even if the averaged pressure in the pressure accumulator 40 lies above the pressure $P_{max}$ critical for the injector opening. Therefore, a functionality is proposed by means of which an adjustment of the camshaft 34 by means of the camshaft adjuster 58 is possible, such that the start of injection of the injector valves 42 is relocated into regions expedient with regard to pressure, specifically the pressure troughs 50. This function is also stored in the control device 26, and the functionality may optionally be withdrawn again in a manner dependent on the pressure conditions in the fuel injection system 10.

Figure 7:
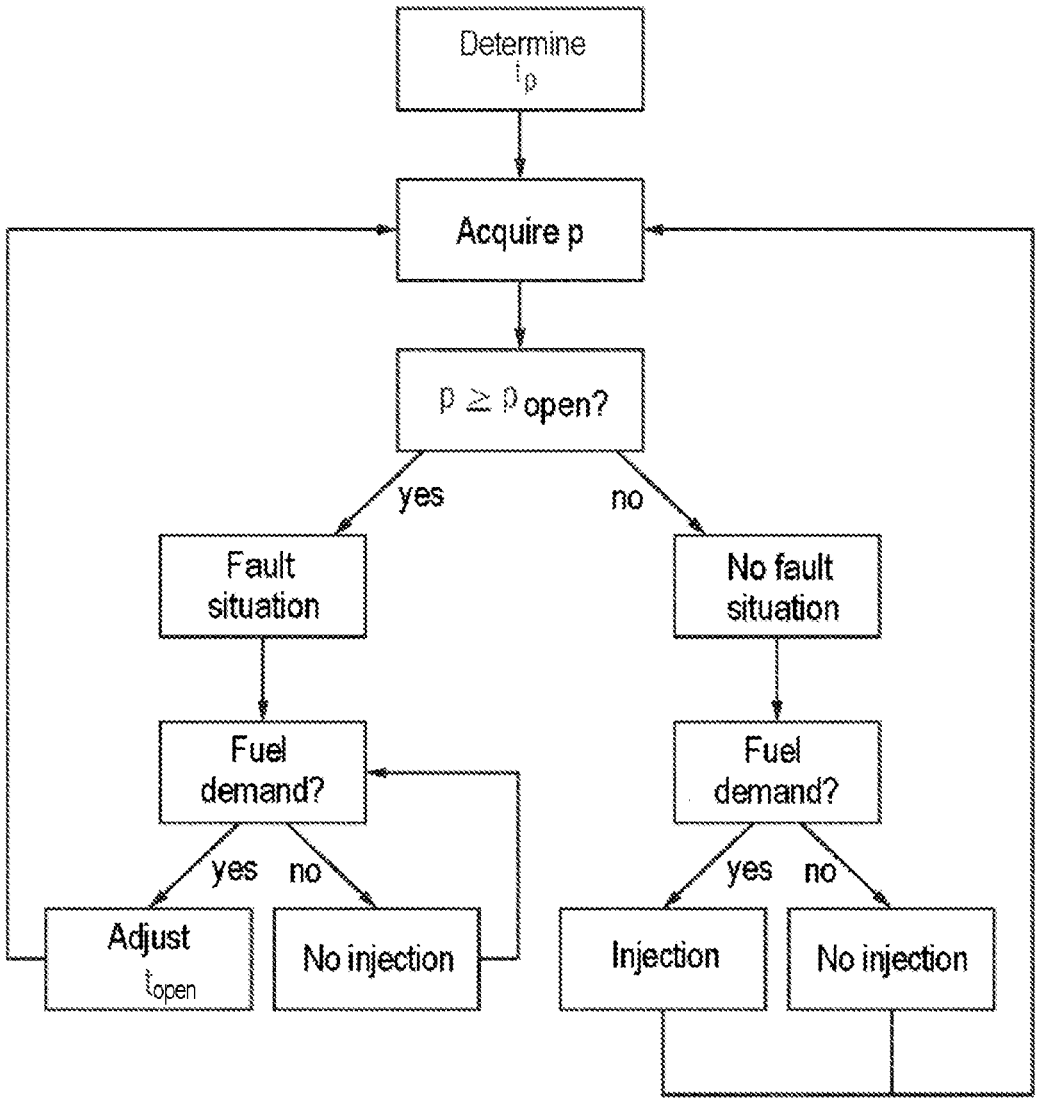
FIG. 7 shows a flow diagram which schematically illustrates an actuation method for the actuation of an injector valve of the fuel injection system from FIG. 1 in a fault situation of the fuel injection system.
Figure 8:
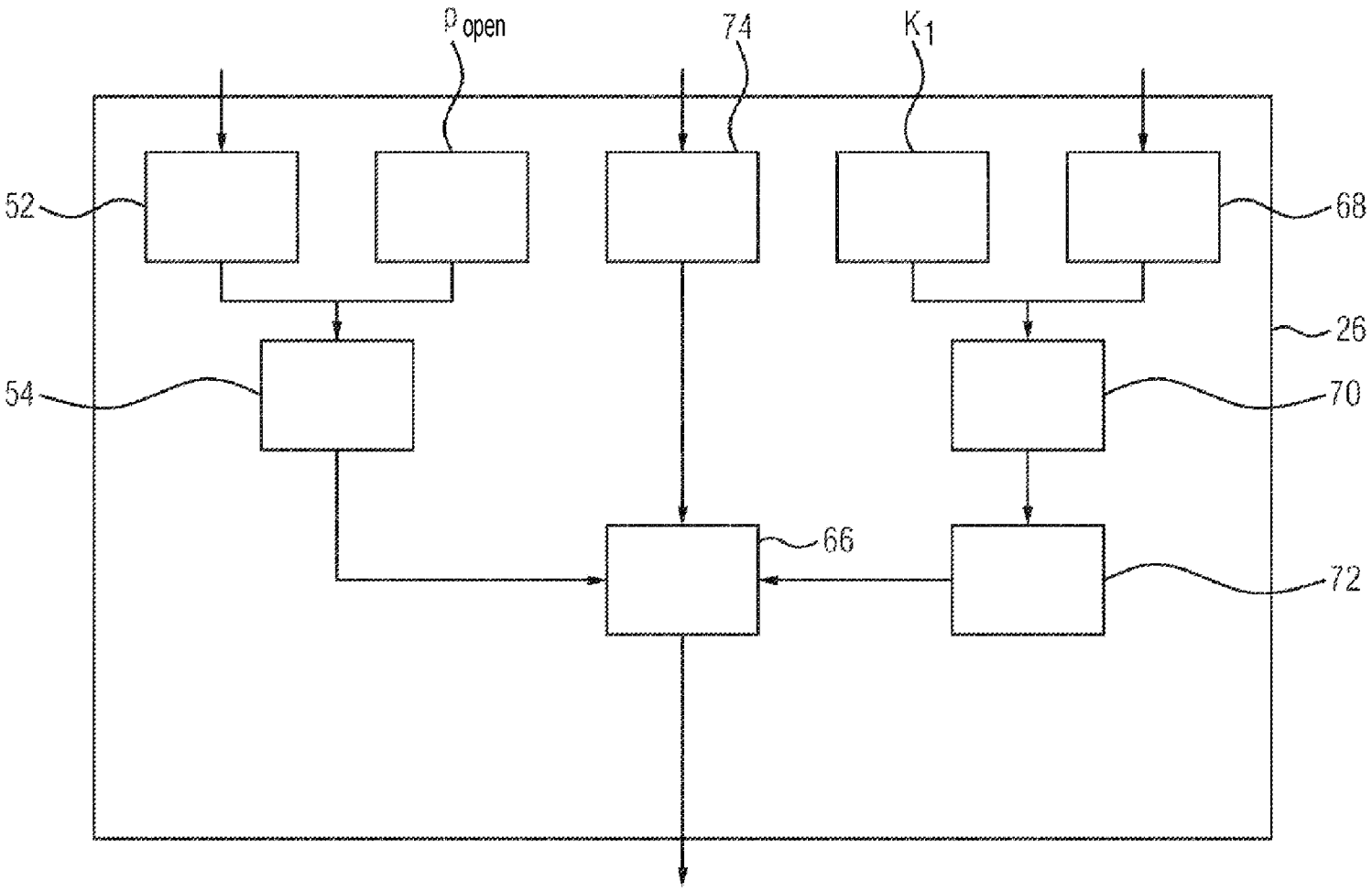
FIG. 8 shows a control device which is designed for carrying out the actuation method as per FIG. 7.

Below, with regard to FIG. 7 and FIG. 8, a third method will be described with which it is sought for an opening of the injector valves 42 to remain possible even in the fault situation of the fuel injection system 10. This method may be carried out in addition to the overrun deactivation and as an alternative to the adjustment of the camshaft 34. Here, too, the phenomenon is utilized whereby an injector valve 42 that seeks to open during a pressure peak 48 must open counter to a higher pressure than if it were to do so in a pressure trough 50. The difference between the pressure peak 48 and the pressure trough 50 is system-dependent, and may amount to for example 50 bar.

If the respective injector valve 42 opens in a pressure trough 50, the temperature and rotational speed range in which operation of the internal combustion engine is possible is expanded in relation to the injection during the pressure peak 48. Alternatively, a less expensive or more robust design of the pressure-limiting valve 46 may also be used, with the result of higher maximum pressures $P_{max}$, and under some circumstances exhibit comparable exhibited operation of the internal combustion engine.

As already described, the pressure peak 48 in the high-pressure region 16 correlates with the top dead center TDC of the high-pressure fuel pump 14, wherein the propagation time of the fuel through the fuel injection system 10 proceeding from the outlet valve 36 must additionally be observed. Owing to the mechanical connection of the high-pressure fuel pump 14 to the internal combustion engine, said position of the top dead center TDC is known. As is also the case in the other methods, the fault situation is detected by detection of an undesirably high pressure in the high-pressure region 16 by means of the high-pressure sensor 44.

The start of injection of the injector valves 42 is stored in the control device 26 as a characteristic map.

As in the case of the method for the adjustment of the camshaft angle, the period duration tp between two TDC points of the pump piston 32 is determined, and the period duration TP is divided into four equally sized quadrants Q1 to Q4. Here, the injector valves 42 are actuated such that the opening time $T_{open}$ of the injector valves 42 lies in an opening duration which extends into the second quadrant Q2 and into the third quadrant Q3. This means that the camshaft 34 is not adjusted, but rather the opening time $T_{open}$ of the injector valves 42 is actively shifted. By shifting the opening time $T_{open}$ into the pressure trough 50 specifically only after detection of the fault situation, the described advantages can be utilized. The shift of the opening time $T_{open}$ during operation of the internal combustion engine is not relevant to emissions, because it is a fault situation.

Therefore, in the method, as in the case of the adjustment of the camshaft 34, the period duration tp is firstly determined, and it is then detected whether or not a fault situation is present.

In this case, too, the injector valves 42 are actuated only when a fuel demand from the internal combustion engine is actually present. If this is the case, the opening time $T_{open}$ is shifted into the second quadrant Q2 or third quadrant Q3 of the period duration tp. However, if no fuel demand is present, no injection occurs.

After the shift of the opening time $T_{open}$, it is in turn checked whether the fuel injection system 10 remains in a fault situation, because it is optionally possible in this case too for the functionality to be withdrawn again if the fuel injection system 10 enters the normal mode again. In this case, the injection in the period duration tp occurs as desired in any of the four quadrants Q1 to Q4 directly in accordance with a fuel demand from the internal combustion engine.

Therefore, in the control device 26, a functionality is stored which, after the detection of a fault situation with an associated pressure increase in the high-pressure region 16, shifts the existing opening time $T_{open}$ of the injector valves 42 for normal operation into a range which is more optimum for emergency running of the internal combustion engine. For this purpose, in the control device 26, a corresponding characteristic map may be stored, for example in the form of the opening time setting device 66, which shifts the opening time $T_{open}$ of the injector valves 42 such that it lies in the pressure trough 50. The characteristic map may optionally be configured as a function of pressure and/or temperature and/or rotational speed of the internal combustion engine.

The shift of the opening time $T_{open}$ may optionally be withdrawn again in a manner dependent on the pressure conditions in the system.

The invention claimed is:

1. A control method for controlling a fuel injection system of an internal combustion engine, the method comprising:

providing a fuel injection system having a high-pressure fuel pump with a pump piston which moves between a bottom dead center and a top dead center (TDC) in a pressure chamber during operation and which serves for highly pressurizing a fuel, having a camshaft for driving the pump piston and having a high-pressure region with at least one injector valve for injecting highly pressurized fuel into a combustion chamber of an internal combustion engine;

providing a pressure-limiting valve which, when a predefined opening pressure is reached in the high-pressure region discharges fuel from the high-pressure region into the pressure chamber of the high-pressure fuel pump;

detecting a fault situation in the fuel injection system, wherein the predefined opening pressure is overshot in the high-pressure region;

determining a period duration with four evenly distributed quadrants between a first TDC time, at which the pump piston is at the top dead center (TDC), and a second TDC time, at which the pump piston is at the top dead center;

setting an injection time at which the injector valve begins to inject fuel;

providing a camshaft adjuster for adjusting a camshaft angle of the camshaft relative to the pump piston;

adjusting the camshaft angle of the camshaft such that the injection time lies in a duration which extends in a second quadrant of the period duration and/or in a third quadrant of the period duration.

2. The method of claim 1, wherein the fault situation is detected by a high-pressure sensor arranged in the high-pressure region.

3. The method of claim 1, wherein the opening pressure of the pressure-limiting valve is set to be lower than a maximum admissible maximum pressure in the high-pressure region and wherein the maximum pressure is defined in particular in a range above 500 bar.

4. The method of claim 1, wherein:

the injection time is set dependent on a fuel demand from the internal combustion engine.

5. The method of claim 1, wherein:

upon detection of re-entry into a normal mode of the fuel injection system in which the predefined opening pressure is undershot again in the high-pressure region adjustment of the camshaft is ended in a manner dependent on the set injection time.

6. The method of claim 1, wherein, a characteristic map is stored, which assigns every camshaft angle of the camshaft relative to the pump piston at a predetermined TDC time.

7. The method of claim 1, wherein at least two operating modes of the internal combustion engine are provided, wherein, in an overrun mode, no injection of fuel through the injector valve into the combustion chamber takes place, wherein, in an injection mode, at least one injection of fuel through the injector valve into the combustion chamber takes place, wherein, in the fault situation, the overrun mode of the internal combustion engine is deactivated, such that the internal combustion engine is operated exclusively in the injection mode.

8. The method of claim 7, wherein, a quantity of fuel is injected through the injector valve at a high pressure which is lower than the maximum pressure and which corresponds to an opening pressure of the pressure-limiting valve in the high-pressure region.

9. A fuel injection system for injecting fuel into combustion chambers of an internal combustion engine, the system comprising:

a high-pressure fuel pump with a pump piston which moves between a bottom dead center and a top dead center (TDC) in a pressure chamber during operation and which serves for highly pressurizing a fuel;

a camshaft which drives the pump piston and which has a camshaft adjuster configured to adjust a camshaft angle of the camshaft relative to the pump piston;

at least one injector valve-configured to inject pressurized fuel into a combustion chamber of the internal combustion engine from a high-pressure region;

a pressure-limiting valve configured to discharge fuel from the high-pressure region into the pressure chamber of the high-pressure fuel pump when a predefined opening pressure is reached in the high-pressure region; and a control device configured to:

detect a fault situation in the fuel injection system when the predefined opening pressure is overshot in the high-pressure region and, determine a period duration with four evenly distributed quadrants between a first TDC time, at which the pump piston is at the top dead center, and a second TDC time, at which the pump piston is at the top dead center, and set an injection time at which the injector valve begins to inject fuel;

and adjust the camshaft angle of the camshaft relative to the pump piston such that the injection time lies in a duration which extends in a second quadrant of the period duration and/or in a third quadrant of the period duration.

10. The fuel injection system of claim 9, wherein the fault situation is detected by a high-pressure sensor arranged in the high-pressure region.

11. The fuel injection system of claim 9, wherein the opening pressure of the pressure-limiting valve is set by the control device to be lower than a maximum admissible maximum pressure in the high-pressure region and wherein the maximum pressure is defined in particular in a range above 500 bar.

12. The fuel injection system of claim 9, wherein the injection time is set by the control device dependent on a fuel demand from the internal combustion engine.

13. The fuel injection system of claim 9, wherein:

upon detection by the control device of re-entry into a normal mode of the fuel injection system in which the predefined opening pressure is undershot again in the high-pressure region adjustment of the camshaft is ended in a manner dependent on the set injection time.

14. The fuel injection system of claim 9, wherein, a characteristic map is stored in memory in the control device, which assigns every camshaft angle of the camshaft relative to the pump piston at a predetermined TDC time.

15. The fuel injection system of claim 9, wherein at least two operating modes of the internal combustion engine are utilized, wherein, in an overrun mode, no injection of fuel through the injector into the combustion chamber takes place, wherein, in an injection mode, at least one injection of fuel through the injector valve into the combustion chamber takes place, and wherein, in the fault situation, the overrun mode of the internal combustion engine is deactivated, such that the internal combustion engine is operated exclusively in the injection mode.

16. The fuel injection system of claim 15, wherein, a quantity of fuel is injected through the injector valve at a high pressure which is lower than the maximum pressure and which corresponds to an opening pressure of the pressure-limiting valve in the high-pressure region.

* * * * *